US009296090B2

(12) United States Patent
Bronzino

(10) Patent No.: US 9,296,090 B2
(45) Date of Patent: Mar. 29, 2016

(54) CLAMPING DEVICE

(71) Applicant: OML spa, Travacò Siccomario (IT)

(72) Inventor: Walter Bronzino, Condove Torino (IT)

(73) Assignee: OML srl, Travacò Siccomario (IT)

( * ) Notice: Subject to any disclaimer, the term of this patent is extended or adjusted under 35 U.S.C. 154(b) by 133 days.

(21) Appl. No.: 14/064,849

(22) Filed: Oct. 28, 2013

(65) Prior Publication Data

US 2014/0117606 A1 May 1, 2014

(30) Foreign Application Priority Data

Oct. 26, 2012 (EP) ..... 12190124

(51) Int. Cl.
*B25B 1/24* (2006.01)

(52) U.S. Cl.
CPC ..... *B25B 1/241* (2013.01); *B25B 1/2405* (2013.01)

(58) Field of Classification Search
CPC ..... B25B 1/241; B25B 1/24; B25B 1/10; B25B 1/20; B25B 1/2421; B25B 1/2405
USPC ..... 269/43, 45, 156, 246, 41, 104, 100, 163
See application file for complete search history.

(56) References Cited

U.S. PATENT DOCUMENTS

| | | | | | |
|---|---|---|---|---|---|
| 164,291 | A * | 6/1875 | Gleason et al. | ..... | 72/452.3 |
| 1,454,148 | A * | 5/1923 | Bisset | ..... | 279/123 |
| 1,883,335 | A * | 10/1932 | Braden | ..... | 76/107.8 |
| 4,221,391 | A * | 9/1980 | Dutton | ..... | 279/123 |
| 4,251,066 | A * | 2/1981 | Bowling | ..... | 269/283 |
| 4,602,772 | A * | 7/1986 | Wight et al. | ..... | 269/282 |
| 4,706,949 | A * | 11/1987 | Dossey et al. | ..... | 269/283 |
| 4,960,285 | A * | 10/1990 | Doi | ..... | 279/123 |
| 6,170,813 | B1 * | 1/2001 | Bowers | ..... | 269/282 |
| 6,196,536 | B1 * | 3/2001 | Hintze | ..... | 269/282 |
| 6,957,809 | B1 * | 10/2005 | Ferrara et al. | ..... | 269/283 |
| 2002/0056955 | A1 | 5/2002 | Klabo | | |
| 2009/0217791 | A1 * | 9/2009 | Battenfeld et al. | ..... | 81/421 |
| 2010/0230884 | A1 | 9/2010 | Nelson | | |

FOREIGN PATENT DOCUMENTS

| | | | |
|---|---|---|---|
| AT | 389270 | B | 11/1989 |
| DE | 2134401 | A1 | 2/1972 |
| DE | 19756793 | A1 | 6/1999 |

(Continued)

*Primary Examiner* — Moinca Carter
*Assistant Examiner* — Nirvana Deonauth
(74) *Attorney, Agent, or Firm* — Pandiscio & Pandiscio

(57) ABSTRACT

A clamping jaw for clamping workpieces attached on a clamping fixture, the height of the clamping jaw being about 3.5 millimeters, or less, without sacrificing a reliable and durable connection between the clamping element and the workpiece clamped, wherein the clamping jaw is provided with two contact surfaces and clamping surfaces facing towards the workpiece and which are in active contact with the workpiece in the clamped condition and extend at right angles to one another, one or more recesses in the clamping surface, each provided with a triangular shaped inner contour, one tip of each recess faces away from the clamping surface, one clamping element is disposed in each recess, the outer contour of the clamping element corresponding to an inner contour of the recess, and an end flank of the clamping element facing towards the workpiece having clamping pin therein, and the clamping pins project beyond the clamping surface of the clamping jaw.

15 Claims, 6 Drawing Sheets

(56) References Cited

FOREIGN PATENT DOCUMENTS

| | | | |
|---|---|---|---|
| DE | 202009016994 | U1 | 4/2011 |
| EP | 1693153 | A2 | 8/2006 |
| EP | 2070655 | A2 | 6/2009 |
| EP | 2105257 | A2 | 9/2009 |
| JP | 2002219626 | A | 8/2002 |
| WO | WO 9952678 | A1 | 10/1999 |

* cited by examiner

CLAMPING DEVICE

BACKGROUND OF THE INVENTION

1. Field of the Invention

The present invention relates to a clamping jaw, and to a clamping element for use in the clamping jaw.

2. Description of the Prior Art

A clamping jaw is disclosed in EP 1693153 A2, in the surface of which semicircular recesses are machined. Round clamping elements are inserted in the recesses, which are thus mounted in a rotating arrangement in the recesses and project therefrom in part. Clamping pins, tapering to a point, are provided on the surface of the clamping element facing towards the workpiece to be clamped, whereby the clamping pins act on the workpiece in the clamped condition, penetrating into the workpiece, given appropriate clamping force, and effecting a plastic deformation in it, as a result of which a positive active connection is established between the clamping elements and the workpiece. The clamping elements are arranged on the top side of the clamping jaw, and project outwards from the top side plane.

The ability of the clamping elements to rotate in the corresponding recess are adapted to effect an alignment of the corresponding clamping elements with regard to the outer contour of the workpiece to be clamped, in order to achieve a reliable and durable positive connection between the clamping elements and the workpiece during the clamped condition.

However, the clamping elements are mounted in a rotating arrangement in the recesses, which means that there is a disadvantage that a significant clamping force must be exerted in order to achieve any reliable clamping, as well as plastic deformation, because the clamping pins are pushed away from the workpiece as soon as the clamping pins come into active contact with the workpiece. As a result, each clamping situation leaves the impression of a different clamping pin on the workpiece. This impression arises practically indiscriminately, which means that it cannot be used further during unclamping and re-clamping in order to clamp the workpiece in a different machine tool. As a result, damage to the workpiece increases with the number of clamped conditions.

Furthermore, the clamping elements are arranged at a clamping height of about 10 millimeters in order to be able to transmit any clamping forces whatsoever onto the workpiece. Consequently, the workpiece is damaged at this clamping height. This refers to the clamping height from a lower edge of the workpiece to the level of the highest clamping height.

AT 389270 B discloses a clamping fixture with two clamping jaws movable towards one another. Triangular clamping elements are provided on the upper side of the clamping jaws. Clamping elements running adjacent to one another form a common plane with their end surface that faces towards the workpiece.

These clamping elements provide a clamping surface in, or on which, no clamping pins, clamping pegs, or the like, disposed, as the result of which an exclusively friction-locking active connection is produced between the clamping elements and the workpiece to be clamped.

The task of the present invention is therefore to improve a clamping jaw, or a clamping element, of the aforementioned types such that the clamping height of the clamping elements can be reduced to 3.5 millimeters, or less, without sacrificing reliable and durable active connection between the clamping elements and the workpiece clamped. Furthermore, by means of the clamping elements, it is possible to achieve an even profile of indentations in the workpiece, as a result of which identically configured clamping pins and clamping elements will engage in the already existing indentations in the workpiece in order to allow the workpiece to be attached in precisely the previous position on several different machine tools without requiring additional indentations in the workpiece. Also, the clamping force to be applied can be transmitted onto the workpiece such that the clamping elements are held on the clamping jaw with as little play as possible, such that there is no slippage or rotation when active contact is made with the workpiece.

SUMMARY OF THE INVENTION

Inasmuch as recesses in the clamping jaw have a triangular inner contour, and the tip of the recess faces away from the clamping surface, it is feasible to insert a clamping element into the recess without play, as a result of which, when the clamping force is generated, the clamping element penetrates the workpiece by means of clamping pins which protrude from the clamping element, in which case the clamping element is pressed against the two side walls of the recess which, for example, taper towards one another at an angle of 60°, by means of which the clamping force is evenly transmitted from the clamping element to the clamping jaw. In order to achieve plastic deformation, it is firstly necessary to have a correspondingly high clamping-in force and, secondly, for a plurality of clamping pins to be formed, or attached, to the end face of the clamping elements facing towards the workpiece, which make point-by-point active contact with the workpiece and penetrate into it when the advance movement and the clamping force are specified in a defined manner. The clamping pins are configured as trapezoidal bodies and are positioned and configured in relation to one another such that they are adapted to the material from which the workpiece is produced.

In a preferred embodiment, the arrangement of clamping pins on the end face of the clamping elements facing the workpiece is such that a plurality of indentations results in the workpiece in an axial and lengthways direction. The amount of axial penetration depth is limited to 3.5 millimeters in this case, which is measured from a lower edge of a workpiece to an uppermost row of indentations or clamping pins. An arrangement of this kind results in an even contact impression of indentations, with the effect that when the workpiece is unclamped, the resulting indentations serve as an aid to centring when the workpiece must be re-clamped. As a result, even when the workpiece is clamped several times, the result is only two rows of indentations, each of which is aligned with the other in pairs.

It has proved advantageous for the geometrical contours of the clamping pins to be adapted to workpieces made from different materials, because a softer material, such as aluminium, exhibits different deformation properties compared to a harder metal, or steel.

Furthermore, it is particularly advantageous if the side walls of the recess that taper to a common point are tilted out of the plane that is perpendicular to the base, preferably at an angle of 5°, for example. The inner contour of the side walls should be configured tapering from the base in the direction of the upper side of the clamping jaw, with the effect that a dovetailed contour is produced. Side flanks of the clamping elements are adapted to these inclination profiles of the side walls with the effect that the clamping elements can be pushed sideways into the recess, and due to the angled arrangement of the side walls, they are supported upwards because the outside edges of the clamping elements are in contact with the inner side of the side walls. Accordingly, as soon as a clamping force is transmitted from the workpiece onto the clamping element, and the clamping pins penetrate into the surface of the workpiece, the corresponding clamping element is forced in the direction of the base of the clamping jaw due to the angled side walls, with the effect that the clamping element is pressed against the base of the recess and the side walls. This pull-down measure, achieved by design, correspondingly improves the force transmission between the clamping elements and the clamping jaws.

BRIEF DESCRIPTION OF THE DRAWINGS

The drawings shows an illustrative embodiment of a clamping jaw and three variations of clamping elements for different materials of workpieces to be clamped, the details of which are explained below. In the drawings.

DESCRIPTION OF THE PREFERRED EMBODIMENTS

Figure 1:
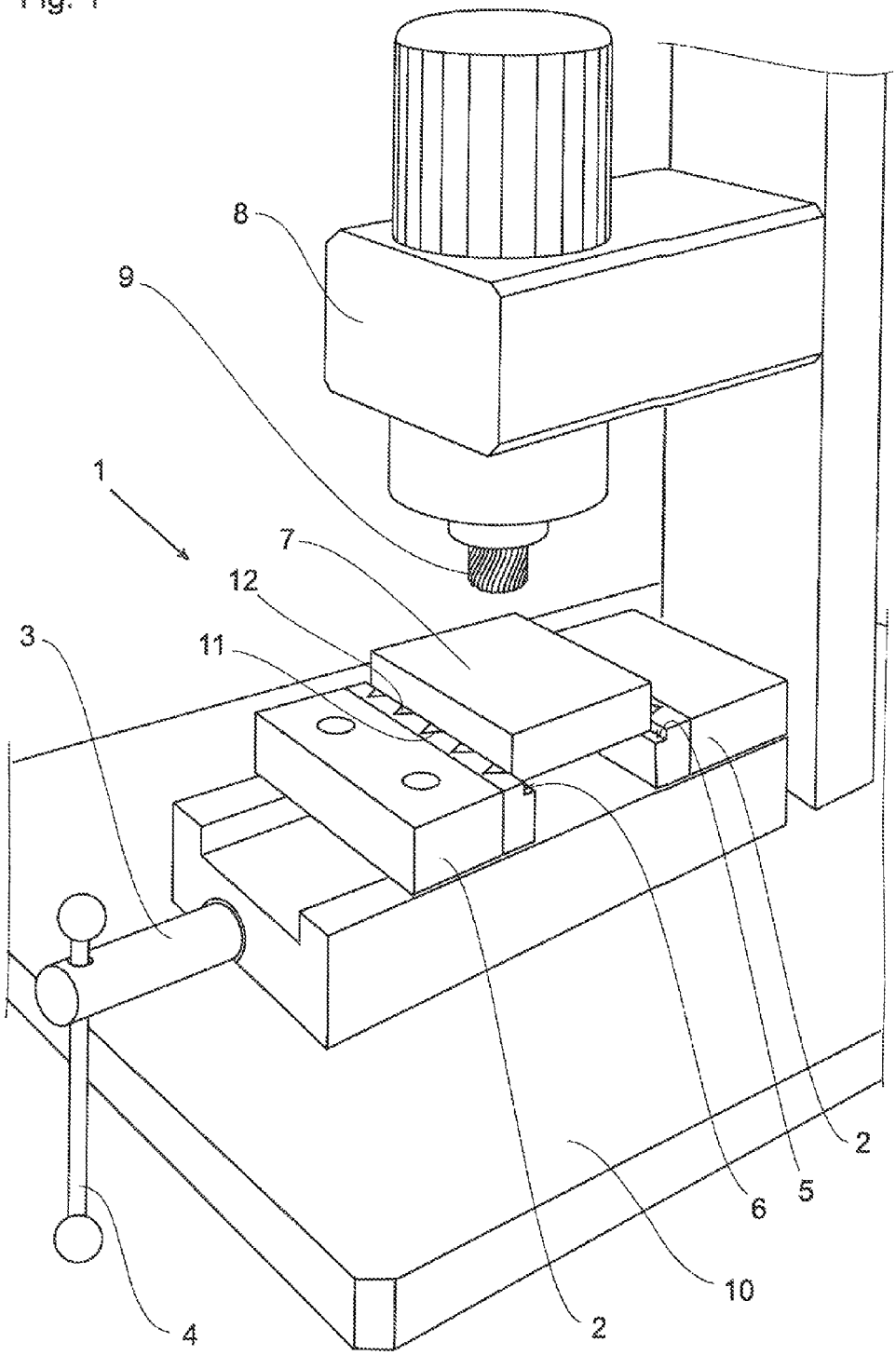
FIG. 1 shows a clamping fixture on a machine tool, with two clamping jaws adjustable towards one another, in each of which five triangular recesses are provided for accommodating corresponding clamping elements, in a perspective view.

FIG. 1 shows a clamping fixture 1 comprising two clamping jaws movable relative to one another. The clamping jaws 2 can be moved by means of a spindle 3 and a lever 4 in such a way that a workpiece 7 to be clamped is held between them and is machined, for example, by a machine tool 8, with a tool 9 configured as a milling head fixed thereon. The machine tool 8 exerts a high machining force on the workpiece 7, as a result of which the workpiece 7 is reliably and durably locked between the two clamping jaws 2. The clamping fixture 1 is attached to a table 10 allocated to the machine tool 8, and is thus in a fixed location, or can be moved, relative to the machine tool 8.

Each of the clamping jaws 2 is provided with a contact surface 5 and a clamping surface 6 facing towards and interacting with the workpiece 7, and which are arranged relative to one another in an L-shaped cross-section, meaning that they run together at right angles. The workpiece 7 should lie on the contact surface 5 and be held clamped between the two clamping surfaces 6 facing one another of the two opposite clamping jaws 2.

In order to increase the active connection between the clamping jaws 2 and the workpiece 7, five triangular-shaped recesses 11 are machined into each of the clamping surfaces 6 of the clamping jaws 2, and a clamping element 12 is inserted into each of them without play. The recesses 11 of adjacent clamping jaws 2 extend in alignment with one another in an advantageous embodiment, with the effect that each of the two clamping elements 12 is arranged opposite to one another in pairs. The distance "a" between two adjacent recesses 11 of one of the clamping jaws 2 is of equal size.

Figure 2A:
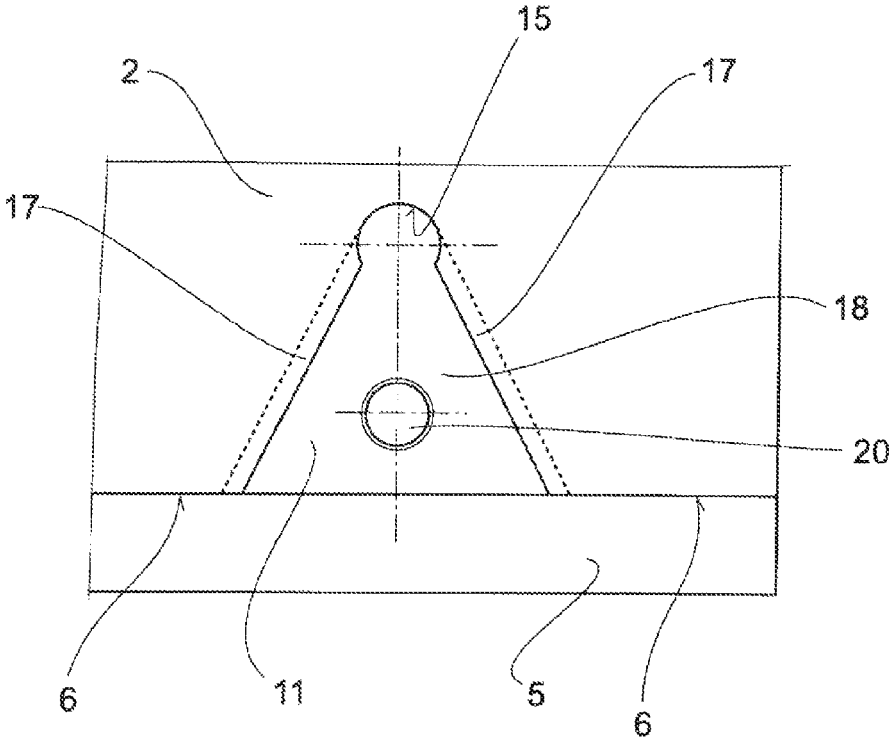
FIG. 2*a* shows one of the clamping jaws in accordance with FIG. 1, in a top view.
Figure 2B:
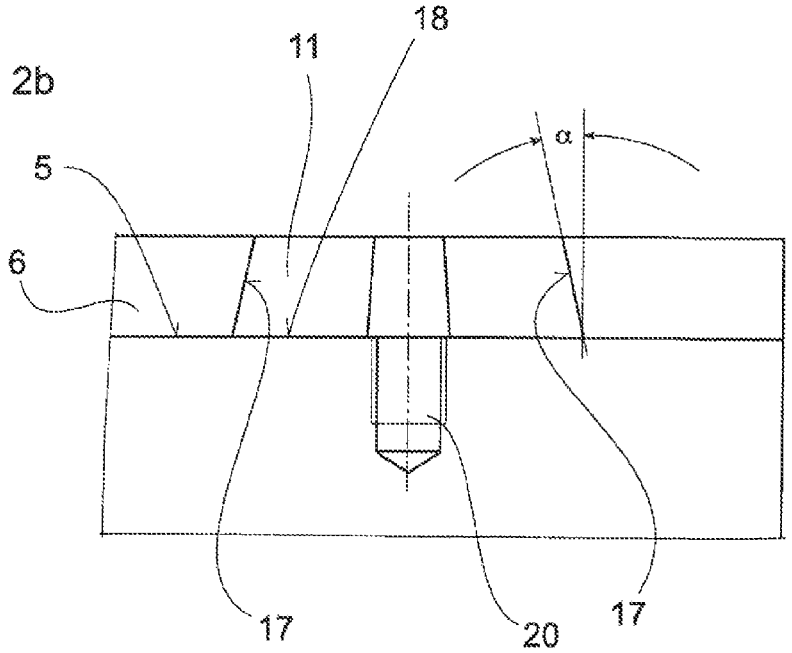
FIG. 2*b* shows the clamping jaw in accordance with FIG. 2*a*, in a front view.

FIGS. 2*a* and 2*b* show that each recess 11 is provided with an open end flank 13 and a tip 15 pointing away therefrom. The tip 15 is thus facing away from the clamping surface 6, whereas the open end flank 13 extends along the plane formed by the clamping surface 6. A threaded hole 20 extends into a base 18 of each recess 11.

Furthermore, the side walls 17 emerging in the tip 15 are located at an angle projecting perpendicularly from the base 18. The inclination angle $\alpha$ is 5°. In this case, the side walls 17 are aligned such that the side walls 17 adjacent to the base 18 are located further apart than the side wall 17 extending in the area of the surface of the clamping jaw 2. As a result, the side walls 17 form a dovetail accommodation opening into which the clamping element 12 coming from the clamping surface 6 is inserted. In order to secure it in the recess 11, there is a passage opening 20' disposed in the clamping element 12, through which a screw 16 is inserted. The screw 16 is then screwed into the threaded hole 20, as a result of which the clamping element 12 is fixed in the recess 11. However, the screw 16 should not be exposed to the clamping forces, or only to a minor extent.

As soon as the clamping element 12 is inserted into the recess 11, it runs in alignment with the clamping surface 6, as a result of which the open end flank 13 of the recess 11 is closed. The outer contour of the clamping element 12 is complementary to the inner contour of the recess 11, as a result of which the clamping elements 12 are inserted into the recess 11 without play. In particular, the side edges 19 of the clamping elements 12 that run adjacent to the side walls 17 of the recess 11 are angled with the identical inclination angle $\alpha$ of 5° from the vertical.

In order to generate a plastic deformation in the workpiece 7, several clamping pins 14 are formed on, or attached to, the clamping element 12, as explained in more detail below; these clamping pins 14 project from the plane formed by the clamping element 12 and the clamping surface 6 at right angles in the direction of the workpiece 7. Consequently, in the clamped condition of the workpiece 7, the clamping pins 14 penetrate into it and the clamping surface 6, as well as the clamping element 12, are located on the surface of the workpiece 7, with the effect that this is additionally held in a friction-locking arrangement.

Figure 3A:
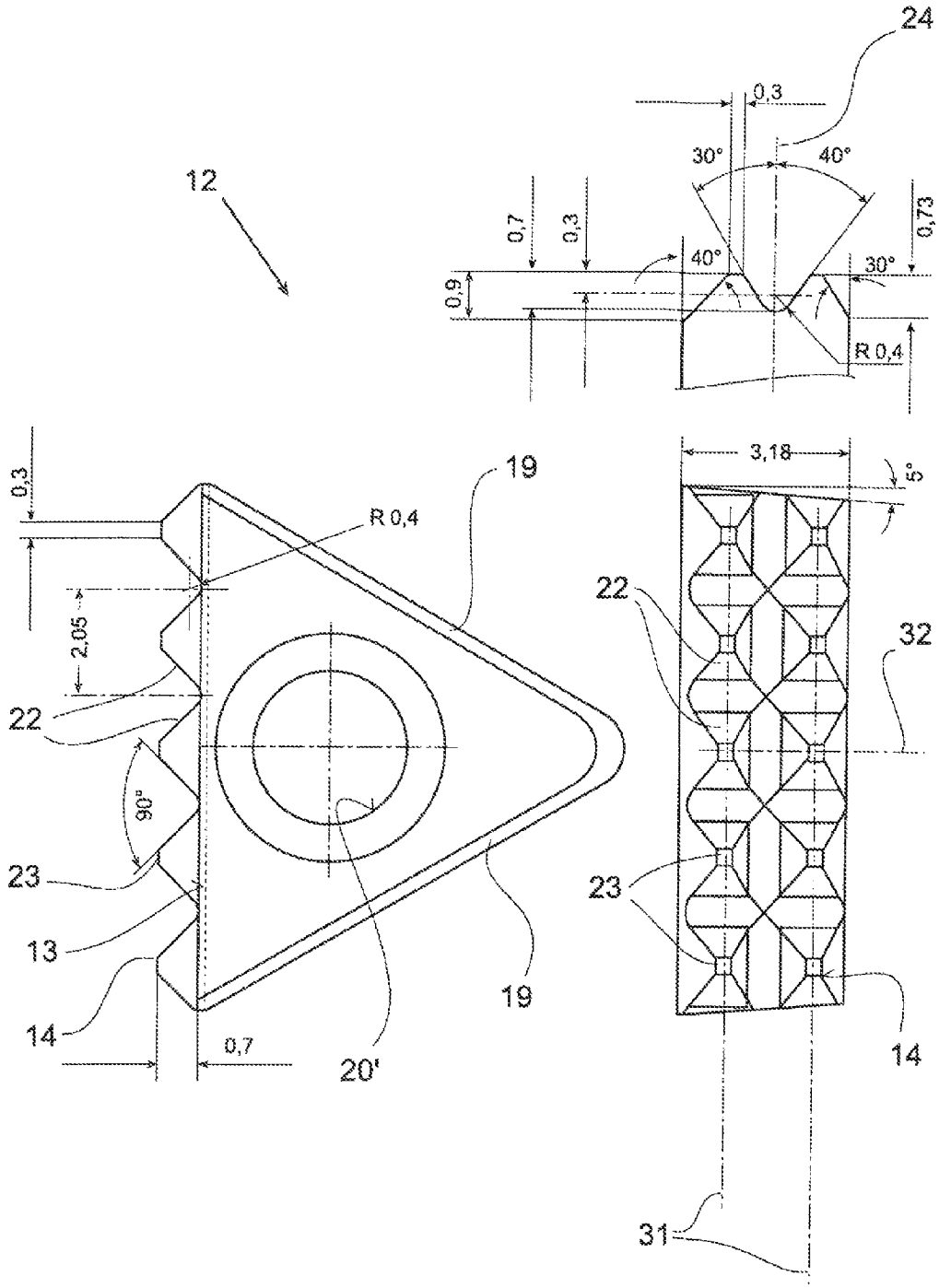
FIG. 3*a* shows a first alternative embodiment of a clamping element in accordance with FIG. 1, in a top view, as well as in a side view, with corresponding geometrical information regarding the configuration of the clamping pins for a workpiece made from hardened metal.
Figure 3B:
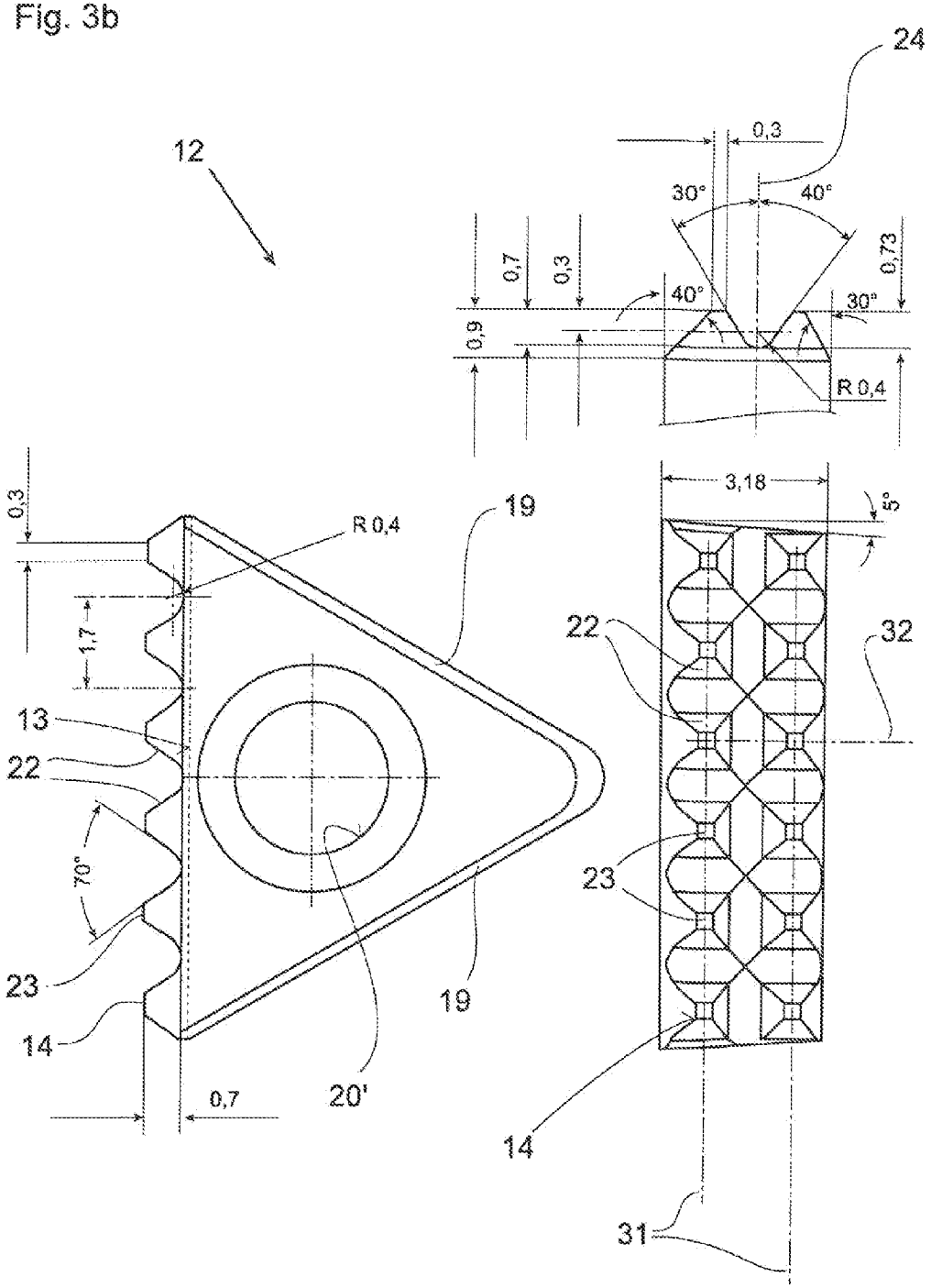
FIG. 3*b* shows a second alternative embodiment of a clamping element in accordance with FIG. 1, in a top view, as well as in a side view, with corresponding geometrical information regarding the configuration of the clamping pins for a workpiece made from steel.
Figure 3C:
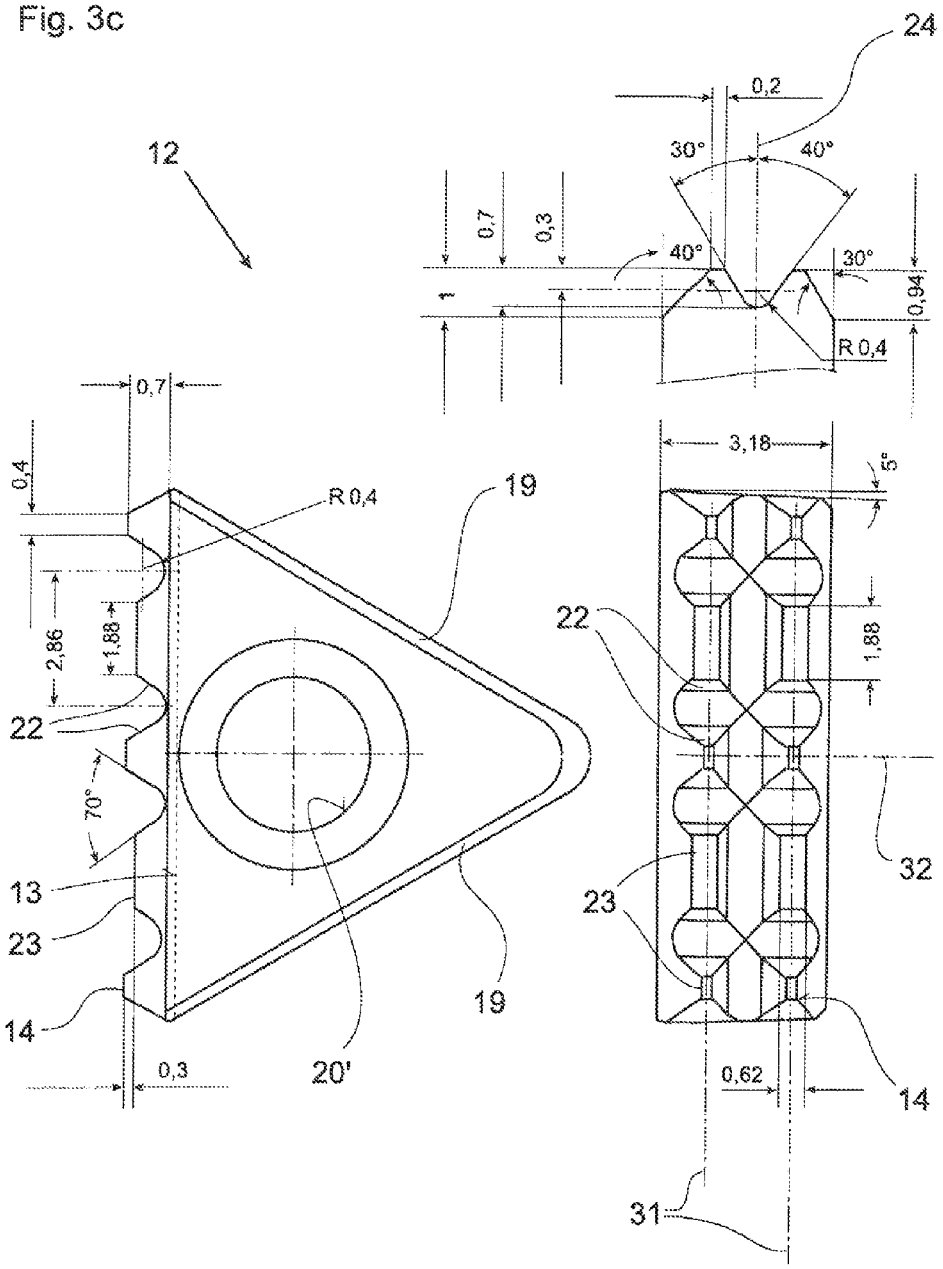
FIG. 3*c* shows a third alternative embodiment of a clamping element in accordance with FIG. 1, in a top view, as well as in a side view, with corresponding geometrical information regarding the configuration of the clamping pins for a workpiece made from aluminium.

The clamping pins 14, explained in more detail in FIGS. 3*a*, 3*b* and 3*c*, are arranged in a particular manner, namely, such that five clamping pins 14 each are arranged in a common row 31 and each clamping pin 14 forming two rows 31 has a clamping pin 14 allocated it, forming a pair 32. The pairs 32 of clamping pins 14 lie along a common access extending at right angles to that formed by the rows 31 of clamping pins 14. This arrangement of clamping pins 14 and the geometrical dimensions of the clamping pins 14 described in more detail below, mean that a uniform pattern of indentations 21 is produced in the workpiece 7 for each configuration variant of the clamping pins 14, and can be used for additional clamping conditions. This means the workpieces 7 can be secured in precisely the same position between the clamping elements 12 after having been unclamped. Consequently, the alignment of the workpiece 7 is retained, as a result of which complicated and time-consuming centring or alignment measures can be dispensed with for the machine tool 8 for machining the workpiece 7. In addition, no unnecessary additional indentations 21 are produced in the workpiece 7.

All clamping pins 14 are configured as trapezoidal bodies, in which case the tip 23 exhibits a smaller cross-section than the base of the clamping pins 14 that runs adjacent to the clamping element 12.

FIG. 3*a* shows a clamping element 12 by means of which a workpiece 7, made from a hardened metallic material, is to be secured. The clamping element 12 facing towards the workpiece 7 is provided with ten clamping pins 14 formed thereon for this purpose, which protrude from the plane formed by the end flank 13. The clamping pins 14 in this case are arranged in pairs 32 and running towards one another in a row 31 on the end flank 13. The height of the clamping pins 14 is 0.7 millimeters measured from the end face of the clamping elements 12, which means the tip 23 is disposed at this distance from the end face 13, and consequently specifies the maximum penetration depth. Two adjacent clamping pins 14 in one of the rows 31 form an angle of 90° with its corresponding side flanks 22, and are connected together at a radius of 0.4 millimeters.

The pairs 32 of clamping pins 14 are located at different angles with their adjacent side flanks, physically at a total angle of 70°, with the right side flank at an angle of 40°, and the left side flank of the particular clamping pins 14 at an angle of 30°.

The tip 23 of a particular clamping pins is provided with a square surface with an edge length of 0.3 millimeters. The overall height of the clamping element 12 is 3.18 millimeters. Measured from the tip 23 of the right clamping pin 14, the height to the edge at which the angle of the side flanks starts is 0.73 millimeters; on the other hand, the left side flank of the left clamping pin 14 extends a distance of 0.9 millimeters between the edge where the side flanks starts and the tip 23.

The side edges 19 of the clamping element 12 are configured at such an angle that the clamping element 12 can be pushed into the corresponding recess 11 with a dovetail shape, where it makes contact without play.

The clamping pins 14 are provided with a trapezoidal shape in their lengthways section. The distance between two clamping pins 14 arranged in row 31, and running adjacent to one another, is 2.05 millimeters. A configuration of this kind for the clamping pins 14 has proven effective, in particular for the hardened metal material, because such clamping pins 14 optimally penetrate a workpiece 7 produced from this material and impose plastic deformation there, as a result of which a positive-locking, or elastic action arrangement, is created between the clamping element 14 and the workpiece 7.

FIG. 3*b* shows a clamping element 12 which is particularly well-suited to clamping a workpiece 7 made from steel. The dimensions of the clamping element 12 in FIG. 3*b* are identical to those in FIG. 3*a*. In this case, the side flanks 22 of two adjacent clamping pins 14 lying in row 31 are arranged at an angle of 70°. In relation to the line of symmetry 24 between two adjacent clamping pins 14, one side flank 22 is aligned at an angle of 40° and the side flank 22 arranged adjacent thereto is aligned at an angle of 30°. The tips 23 of the corresponding clamping pins 14 exhibit a square cross-section with a side length of 0.3 millimeters. The radius between two adjacent side flanks 22 is also 0.4 millimeters. The distance from the clamping pins 14 lying in row 31 is 1.7 millimeters.

FIG. 3*c* shows a clamping element 12 by means of which a workpiece 7 made from aluminium material can be clamped. The side flanks 22 of two adjacent clamping pins 14 aligned in pairs 32 are arranged at an angle of 70° in this case. The tips 23 of the clamping pins 14 are provided with a rectangular configurations that have differently sized cross-sectional surfaces. In this case, two each of the clamping pins 14 which have identical cross sections of their tips 23 are grouped into a pair 32. One of the side lengths of the first pairs 32 of clamping pins 14 is 0.2 millimeters, and the side edges running at right angles to this are 0.4 millimeters long, which means that the cross sectional area is 0.08 $mm^2$. The pairs 32 of clamping pins 14 arranged adjacent thereto have side edges of 1.88 millimeters and 0.4 millimeters or 0.6 millimeters. As a result, the clamping pins 14 arranged in a row 31 are provided with differently sized tips 23 arranged alternately in relation to one another. The average height of the clamping pins 14 is 0.94 millimeters from the end flank 13. Two adjacent side flanks 22 are connected together with a radius of 0.4 millimeters.

The distance between two adjacent clamping pins 14 arranged in a row 31 is 2.86 millimeters, and the height of the clamping pins 14 is 0.7 millimeters, measured from the start of the side flanks 22.

The clamping pins 14 with smaller dimensions project from the larger clamping pins 14 by a distance of 0.3 millimeters. The overall height of the smaller sized clamping pins 14 is 0.94 millimeters measured from the base of the end flank 13.

Figure 4:
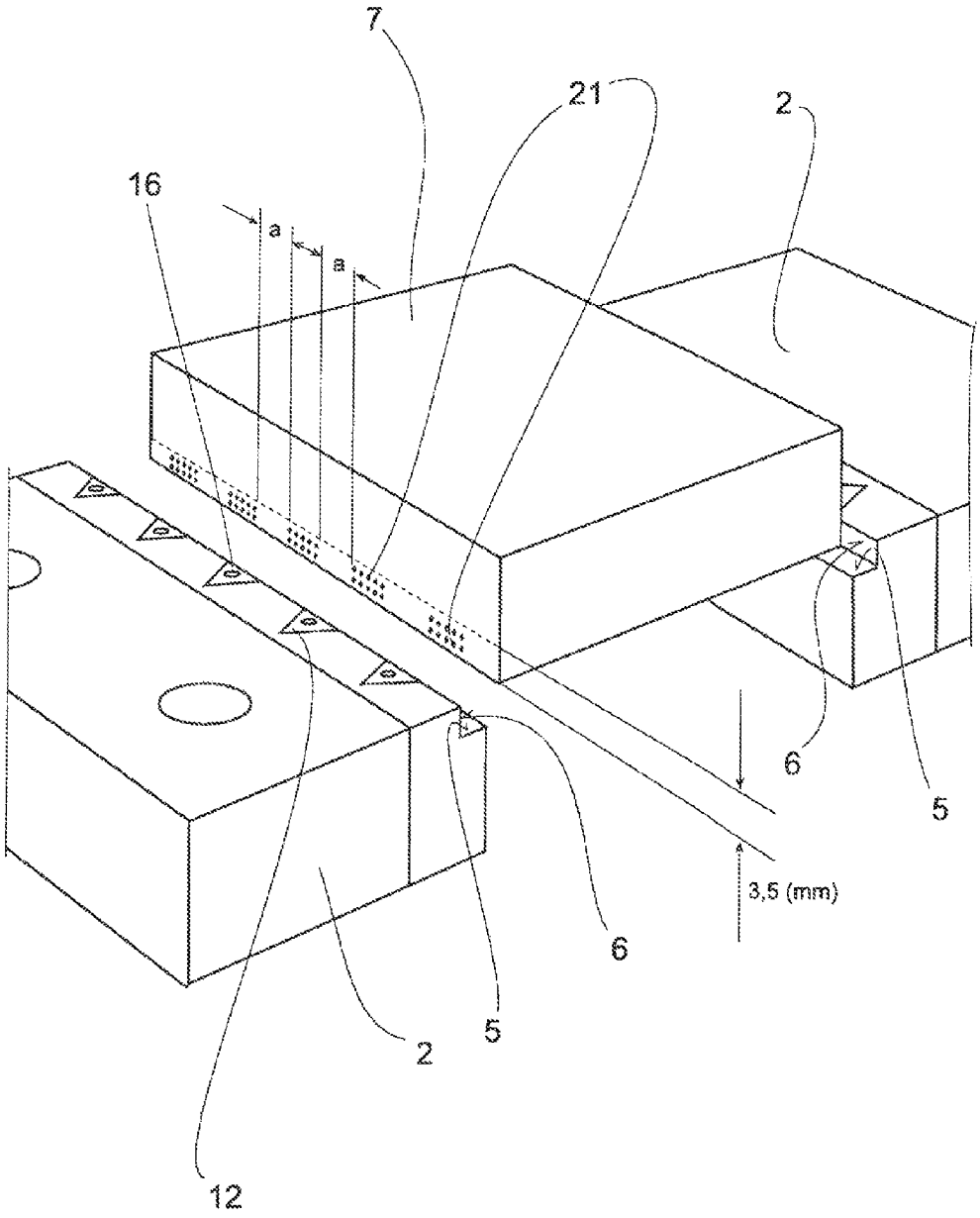
FIG. 4 shows a magnified section of the clamping jaws and the workpiece in accordance with FIG. 1, after the clamped condition has been removed.

FIG. 4 shows which indentations 21 which the clamping pins 14 make in the workpiece 7. Furthermore, the maximum height of the indentations 21 is specified as 3.5 millimeters from the underside of the workpiece 7 that makes contact with the contact surface 5, as a result of which the workpiece 7 is only damaged in a tightly limited area, which can thus be reworked. In fact, the height of the indentations will be less than the 3.18 millimeters.

Often, it is necessary to install the workpiece 7 in various machine tools 8 in order to machine the workpiece in different ways. As a result of the regular arrangement of clamping pins 14 on the end flank 13 of the particular clamping element 12, a perforation, or a pattern of indentations 21, is produced in the workpiece 7 by means of which it is guaranteed that the workpiece 7 can be used on identically configured clamping jaws 2 and clamping elements 12 provided on other machine tools 8. This is achieved in that the workpiece 7 is moved by small axial and vertical amounts along the clamping pins 14, until the clamping pins 14 engage in the indentations 21 existing in the workpiece 7. In this position, the two opposite clamping jaws 2 can be moved together with the effect that the clamping pins 14 exactly penetrate the specified indentations 21 in the workpiece 7 and secure it without creating additional indentations 21, or requiring them.

The reuse of the indentations 21 also means that the workpiece 7 is positioned in the first, or original, clamping condition, with the effect that the workpiece 7 does not need to be re-aligned in relation to the machine tool 8. As a result, the workpiece 7 can be clamped without further ado and re-attached to the same, or another, machine tool 8 for further machining at a later stage, in exactly the same position.

The distance "a" between two adjacent recesses 11 thus is of the same size and geometrical configurations described in FIGS. 3*a* to 3*c* for the trapezoidal bodies forming the particular clamping pins 14 that must be used on the other machine tools 8.

The deformation of the workpiece 7 on penetration by the clamping pins 14 depends both on the advance force, and on the material, of the workpiece 7 to be clamped, which means that both elastic and plastic deformations can occur in the workpiece 7.

In order to achieve a sufficiently great impact strength, or strength for the clamping element 12, or the clamping pins 14, the clamping elements 12 and clamping pins 14 are produced from a sintered solid carbide material. The mixture and the grain size of the particular components of the solid carbide are adapted to produce great impact strength. It is particularly advantageous if the clamping element 12 and clamping pins 14 are made from tungsten carbide with a percentage of 81% and a cobalt binding agent with a percentage of 8%. Furthermore, additional ingredients are required constituting a percentage proportion of 11%.

Such mixtures have an average grain size according to ISO 4499-2:2008, a porosity according to ISO 4505:1978 of A02B00C00, a density of 13.74 g/cm$^3$, a Rockwell hardness of 90.9 on the "A" scale, a Vickers hardness of 1420 on the "HV10" scale, a transverse tensile strength of >2500 Mpa and a coercive force of 140 according to Oersted.

The invention claimed is:

1. A device for clamping a workpiece, the device comprising: a clamping jaw comprising a first jaw and a second jaw for clamping a workpiece which is attachable in an exchangeable arrangement on a clamping fixture, wherein each of said first and second jaws is provided with a contact surface and a clamping surface which face towards said workpiece and which said contact surfaces and clamping surfaces are in direct contact with said workpiece when the device is in a clamped condition, and which said contact surfaces and clamping surfaces extend at right angles to one another, wherein one or more substantially triangularly-shaped recesses are disposed in each of said clamping surfaces, each of said recesses being provided with a substantially triangularly-shaped inner contour which is configured such that a tip of said recess faces away from said clamping surface and an open end flank of said recess extends along said clamping surface; and one clamping element being inserted into each of said recesses, an outer contour of said clamping element being configured to be complementary to said inner contour of said recess and an end flank of said clamping element facing towards the workpiece and having at least one clamping pin formed on said end flank or attached thereto, said at least one clamping pin projecting beyond said clamping surface of said clamping jaw.

2. The device in accordance with claim 1, wherein two side walls of the recess are angled inwardly, at an angle of about 5°, in relation to a plane extending vertically from a base of the recess.

3. The device in accordance with claim 2, wherein said clamping element is provided with two side edges adapted to a tapering inner contour of the side walls of the recess and making contact with the corresponding side walls.

4. The device in accordance with claim 2, wherein when each said clamping pin penetrates into said workpiece, a force vectored in the direction of said clamping surface of each of said first and second jaws is created, by means of which the corresponding clamping element is pressed against said tapering side walls of said recess.

5. The device according to claim 1, wherein each said clamping pin is in communication with said workpiece to be clamped when the device is in the clamped condition, and said clamping pins produce an elastic or plastic deformation in the workpiece by means of which a positively locking direct connection is established between said clamping element and said workpiece to be clamped.

6. The device according to claim 5, wherein each said clamping pin is configured as a trapezoidally shaped body and each tip of each said clamping pin facing said workpiece is provided with a rectangular-shaped surface smaller than a base surface of said clamping pin that faces towards the clamping surface.

7. The device according to claim 6, wherein adjacent side flanks of two clamping pins arranged adjacent to one another form an opening angle of 70° or 90° in relation to one another, said clamping pins acting together as a pair enclosing an angle of 70° and said tip of the corresponding clamping pins acting on said workpiece to be clamped exhibiting a square active surface with a side length of 0.3 millimeters.

8. The device according to claim 7, wherein said two side flanks of said clamping pins lying in the row are connected with a radius of 0.4 millimeters, and have a distance of 2.05 or 1.7 millimeters.

9. The device according claim 7, wherein said two side flanks of one pair of clamping pins are at an angle of 40° or 30° in relation to an axis of symmetry extending therebetween.

10. The device according to claim 6, wherein each tip of each said clamping pin is provided with a rectangular-shaped active surface with a selected edge length of 0.2 and 0.4 millimeters, or of 0.4 and 0.6 millimeters.

11. The device according to claim 10, wherein each tip of each said clamping pin has a cross-sectional surface of 0.2 by 0.4 millimeters projecting 0.3 millimeters from the tip of the adjacent clamping pin, the cross-sectional surface of which is 1.88 by 0.4 or 0.6 millimeters.

12. The device according to claim 1, wherein said recesses of said first jaw and the second jaw are aligned opposite to one another and distances between said recesses are of equal size.

13. The device according to claim 1, wherein two clamping pins form a pair and five clamping pins extend in a row aligned at right angles to the axis formed by the pair.

14. The device according to claim 1, wherein the height of the corresponding clamping element is 3.18 millimeters, and the depth of the corresponding recess is of the same size.

15. The device according to claim 14, wherein said clamping element and said clamping pins are formed of 81% tungsten carbide having an adapted mixture and grain size, and with a high impact strength.

* * * * *